US011969091B2

(12) United States Patent
Reinhart

(10) Patent No.: US 11,969,091 B2
(45) Date of Patent: Apr. 30, 2024

(54) OUTDOOR FURNITURE FOOT SYSTEM AND METHOD

(71) Applicant: NICKOLAS BRANDS, LLC, Findlay, OH (US)

(72) Inventor: Nickolas Reinhart, Sarasota, FL (US)

(73) Assignee: FINDLAY MACHINE & TOOL, LLC, Findlay, OH (US)

( * ) Notice: Subject to any disclaimer, the term of this patent is extended or adjusted under 35 U.S.C. 154(b) by 0 days.

(21) Appl. No.: 17/883,890

(22) Filed: Aug. 9, 2022

(65) Prior Publication Data

US 2023/0108207 A1 Apr. 6, 2023

Related U.S. Application Data

(60) Provisional application No. 63/252,733, filed on Oct. 6, 2021.

(51) Int. Cl.
*A47B 91/04* (2006.01)

(52) U.S. Cl.
CPC ..... *A47B 91/04* (2013.01)

(58) Field of Classification Search
CPC ..... A47F 91/00; A47F 91/04; F16M 2200/08
See application file for complete search history.

(56) References Cited

U.S. PATENT DOCUMENTS 2,956,605 A * 10/1960 Rapata ..... F16B 37/041 411/531
3,939,752 A * 2/1976 Koscik ..... F16B 21/088 411/548
5,170,972 A * 12/1992 Casals Guell ..... A47B 91/04 16/42 T
5,242,141 A * 9/1993 Chester ..... A47B 91/00 248/188.9
5,878,984 A * 3/1999 Grieser ..... A47B 91/00 248/688
6,623,082 B1 * 9/2003 Huang ..... A47C 7/002 248/188.9
6,883,763 B2 * 4/2005 Bosman ..... A47B 87/002 248/188.9
D570,203 S * 6/2008 Shiomoto ..... 24/297
7,533,858 B2 * 5/2009 Straus ..... A47B 91/06 248/188.8
8,672,601 B2 * 3/2014 Nitsche ..... F16B 19/004 24/297
9,144,309 B2 9/2015 Adams et al.
10,016,058 B2 7/2018 Adams et al.
D962,047 S * 8/2022 Muther ..... D8/395
2002/0004971 A1 * 1/2002 Ichimaru ..... F16B 5/0607 24/297
2006/0016949 A1 * 1/2006 Payne ..... A47B 91/00 248/346.01

(Continued)

*Primary Examiner* — Monica E Millner
(74) *Attorney, Agent, or Firm* — Jacob M. Ward; Ward Law Office LLC

(57) ABSTRACT

The foot for outdoor furniture is provided that includes a base pad and an anchor portion. The anchor portion includes a prong system that is configured to provide a friction fit retention means where the foot coupled to an article of outdoor furniture. The prong system includes an array of teeth configured to permit the foot to be more easily inserted in the article of outdoor furniture while also militating against the article of outdoor furniture from becoming undesirably decoupled from the foot.

18 Claims, 8 Drawing Sheets

(56) References Cited

U.S. PATENT DOCUMENTS

| | | | | |
|---|---|---|---|---|
| 2007/0234507 | A1* | 10/2007 | Vorpahl | A47B 91/066 16/42 R |
| 2009/0056071 | A1* | 3/2009 | Vorpahl | A47B 91/066 16/45 |

* cited by examiner

OUTDOOR FURNITURE FOOT SYSTEM AND METHOD

CROSS-REFERENCE TO RELATED APPLICATIONS

This application claims the benefit of U.S. Utility application Ser. No. 63/252,733 filed on Oct. 6, 2021. The entire disclosure of this application is incorporated herein by reference.

FIELD

The disclosure generally relates to feet for outdoor furniture and, more particularly, to feet for an outdoor chair.

INTRODUCTION

This section provides background information related to the present disclosure which is not necessarily prior art.

It is sometimes useful or necessary to attach one or more floor contacting parts to injected molded plastic furniture, such as a foot. One benefit of using the foot is to provide the article of furniture with improved friction in order to reduce slippage of the article on smooth surfaces. Another is that, when feet are used on an article of furniture with legs such as a chair or table, the amount of internal stress the article must withstand when a load is applied is reduced. The internal stress reduction achieved by using feet can be very significant. Chairs with feet can hold a set weight before failing much longer than a chair provided without feet, where failure can be the result of the legs slipping and splaying under the weight. For instance, in one example, a chair provided with feet resistant to slipping can hold a set weight for over an hour without splaying, but can hold the same weight for only about 1 minute without feet before splaying and compromising the structure and function of the chair. For that chair, and for many other articles of furniture, feet are critical and integral structural and functional components. Other reasons feet may be used are to cushion impacts on the furniture or to protect substrates from being scuffed by the more rigid material comprising the furniture.

Feet are conventionally provided as plastic or rubber caps coupled to terminal ends of the legs of the chair. These caps can rely on a friction fit design that may not perform adequately in certain situations and can fail to remain attached to the legs. Other examples of conventional feet include those coupled to the chair via a bolt and nut fastener. Although these fasteners may remain coupled to the legs of the chair, the weight, complexity, and assembly of the chair is undesirably increased with the addition of such fasteners. Further, such chairs can be more difficult to stack, which is becoming increasingly popular with storing outdoor furniture. Lastly, certain fasteners, including metal fasteners, are not an economical choice for manufacturers in producing low cost outdoor furniture.

Accordingly, there is a need for an improved foot for an article of outdoor furniture that has enhanced durability, provides a means to adequately retain the foot to the article of outdoor furniture, and does not greatly add to the cost of manufacturing the furniture.

SUMMARY

In concordance with the instant disclosure, an improved foot for an article of outdoor furniture that has enhanced durability, provides a means to adequately retain the foot to the article of outdoor furniture, and does not greatly add to the cost of manufacturing the article of outdoor furniture, has been surprisingly discovered.

A foot for an article of outdoor furniture is provided that includes an anchor portion and a base pad. The anchor portion may include a prong system that is configured to provide a friction fit retention means when the foot is coupled to an article of outdoor furniture. A top surface of the base pad may be coupled to the a bottom surface of the anchor portion. The prong system may extend from a top surface of the anchor portion.

A foot for an article of outdoor furniture may be used as part of an outdoor furniture foot system. The outdoor furniture foot system may include a foot for an article of furniture that includes an anchor portion and a base pad. The anchor portion may include a prong system that is configured to provide a friction fit when the foot is coupled to the article of outdoor furniture. The base pad may be coupled to a bottom surface of the anchor portion. The outdoor furniture foot system may further include an article of outdoor furniture configured to be coupled with the foot for an article of outdoor furniture.

The foot may be coupled to an article of outdoor furniture by various methods. One method may include a step of providing a foot having a base pad and an anchor portion. The anchor portion may include a prong system that includes a friction fit retention means which is configured to couple the foot to an article of outdoor furniture. A top surface of the base pad may be coupled to a bottom surface of the anchor portion. An article of outdoor furniture having a substantially vertical wall configured to be accepted by the prong system may be provided. The method may include inserting the prong system of the foot into the article of outdoor furniture, wherein the substantially vertical wall is wedged within the prong system, thereby coupling the foot to the article of outdoor furniture.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
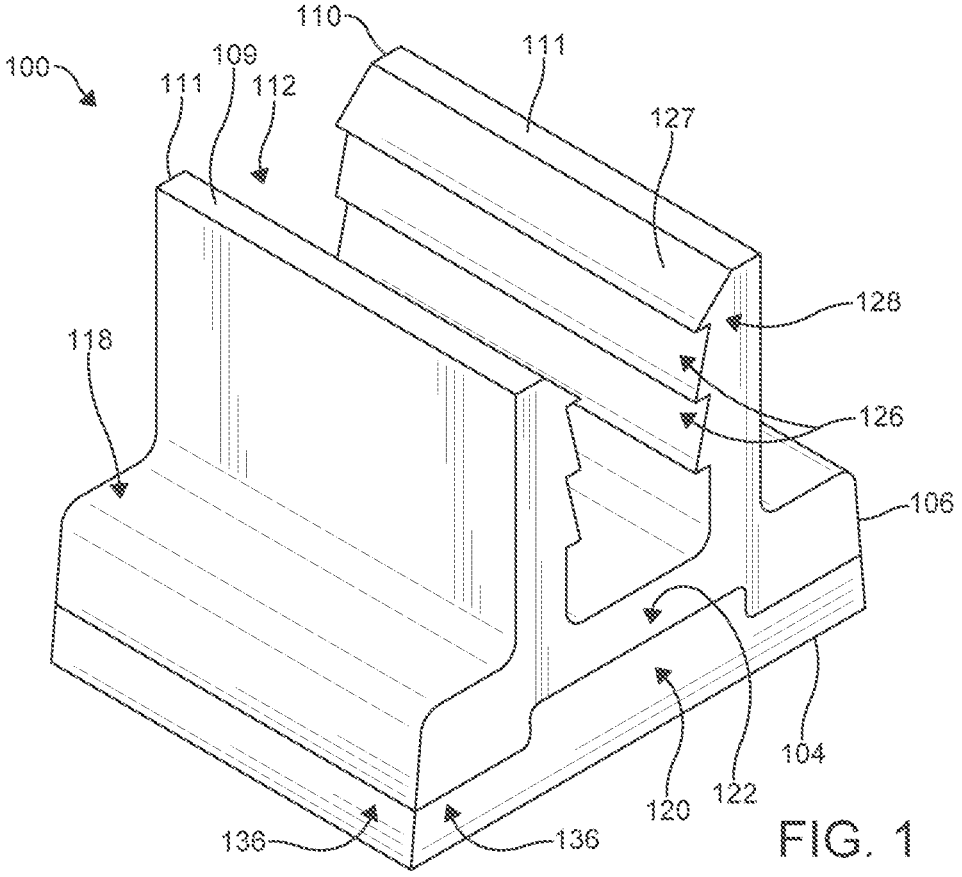
FIG. 1 is a front perspective view of a foot for an article of outdoor furniture, according to an embodiment of the present disclosure.
Figure 2:
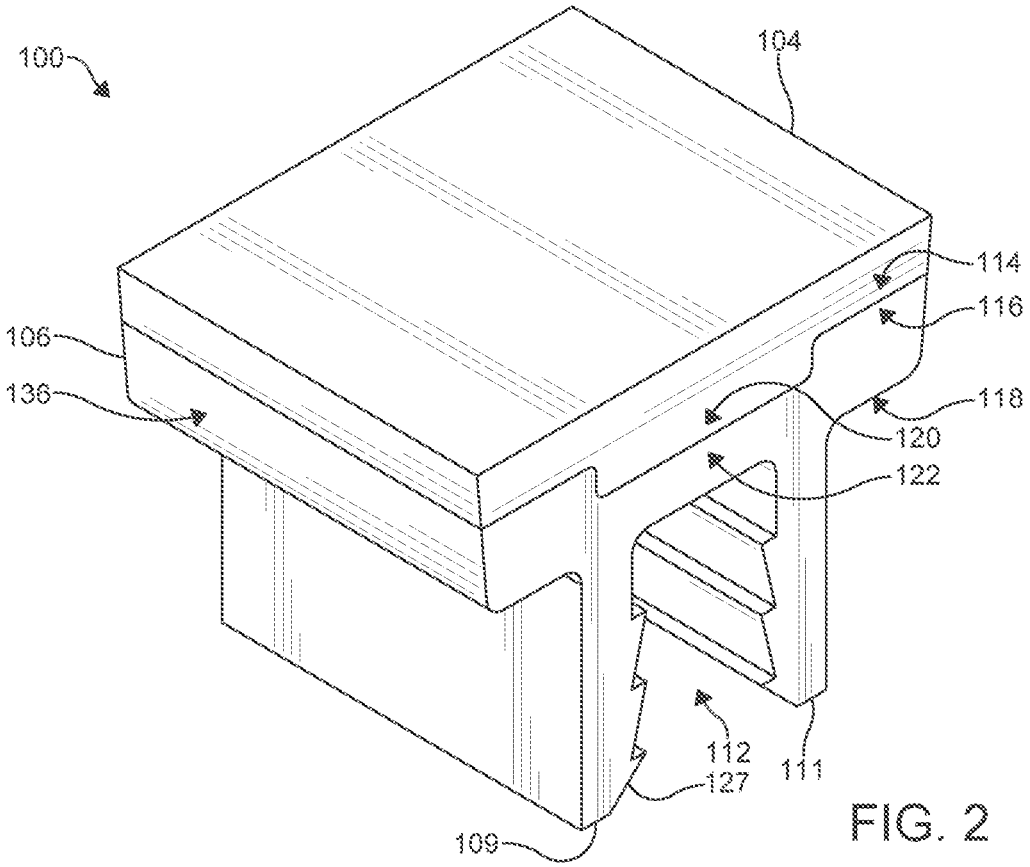
FIG. 2 is a bottom perspective view of the foot.
Figure 3:
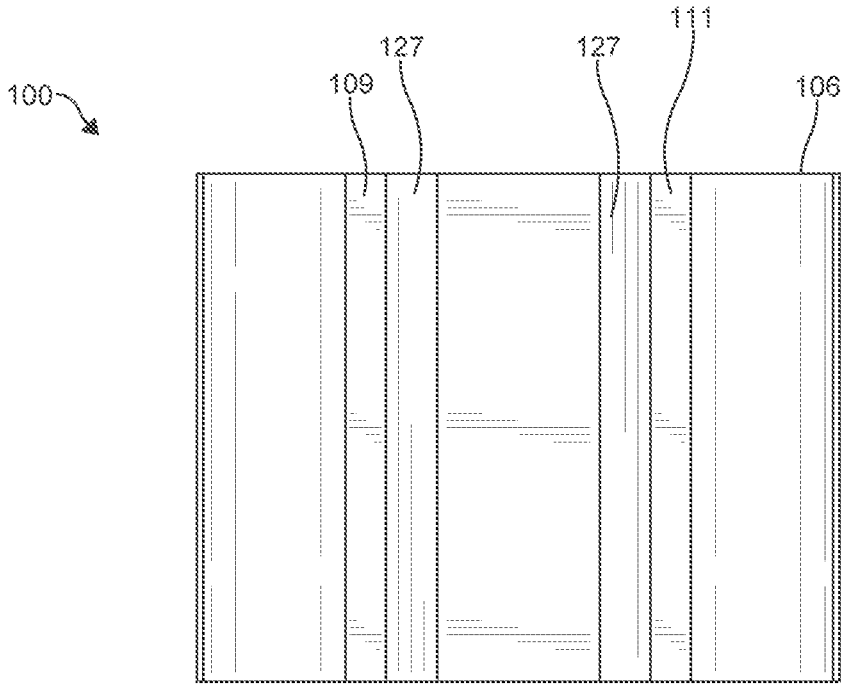
FIG. 3 is a top plan view of the foot.
Figure 4:
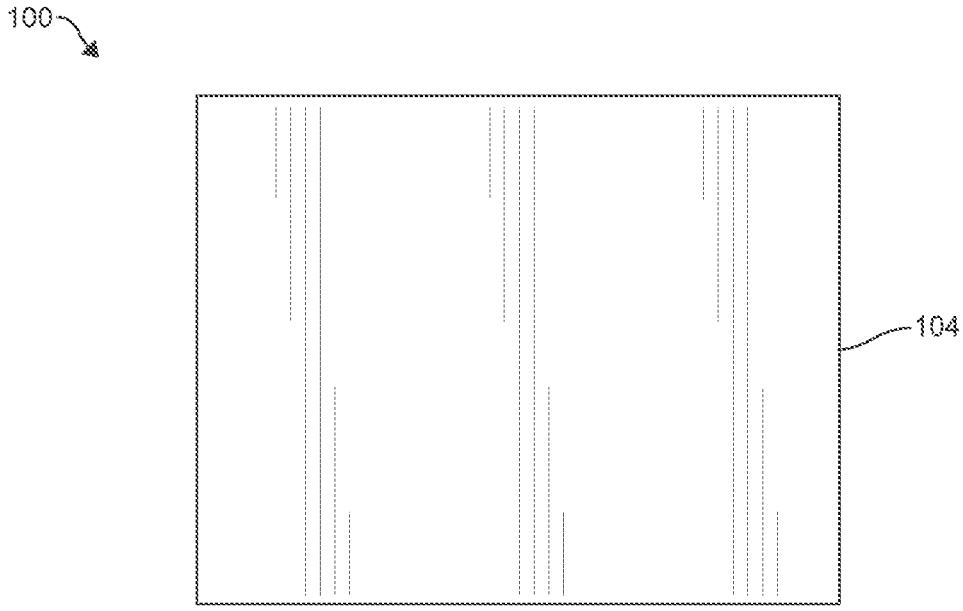
FIG. 4 is a bottom plan view of the foot.
Figure 5:
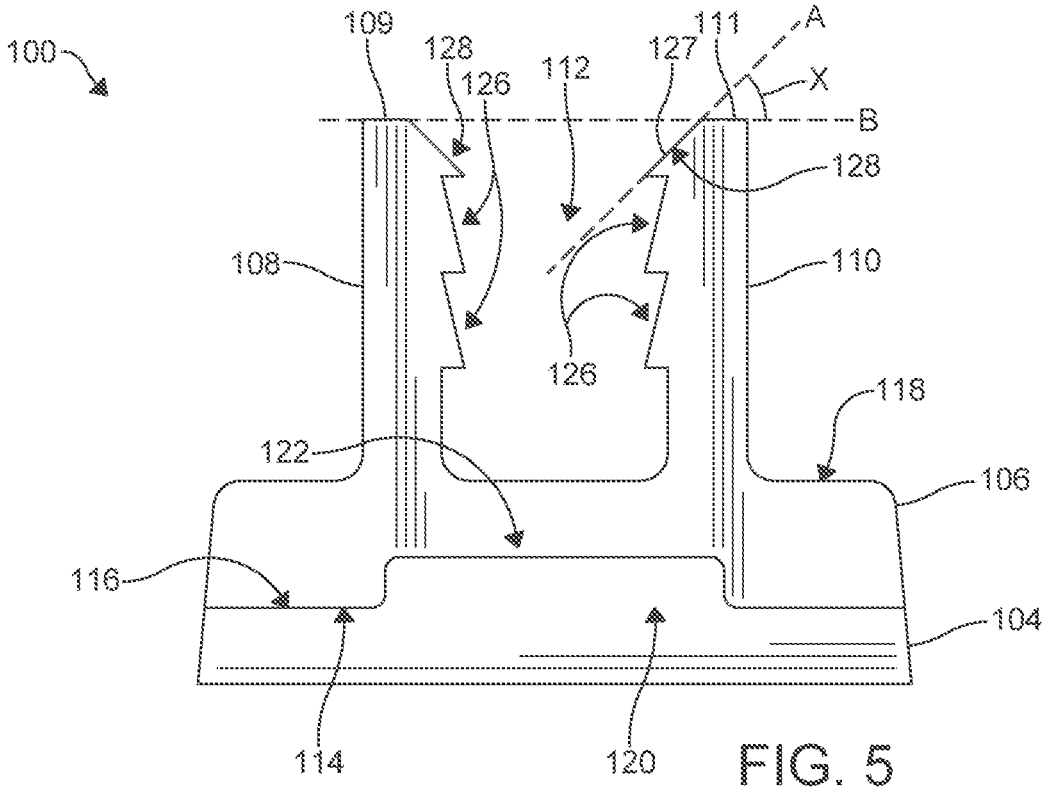
FIG. 5 is a front elevational view of the foot.
Figure 6:
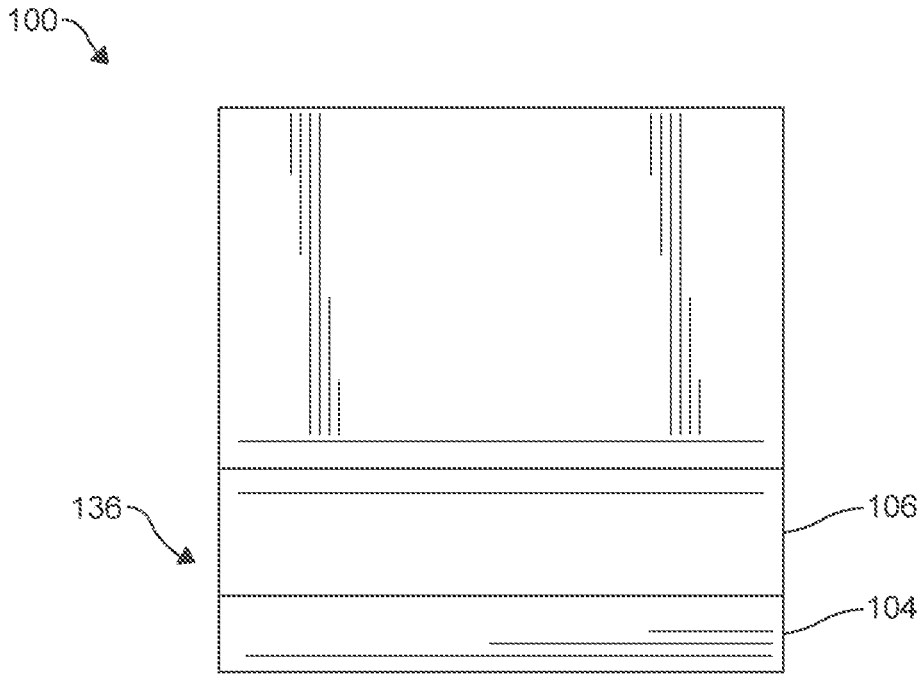
FIG. 6 is a right side elevational view of the foot.
Figure 8:
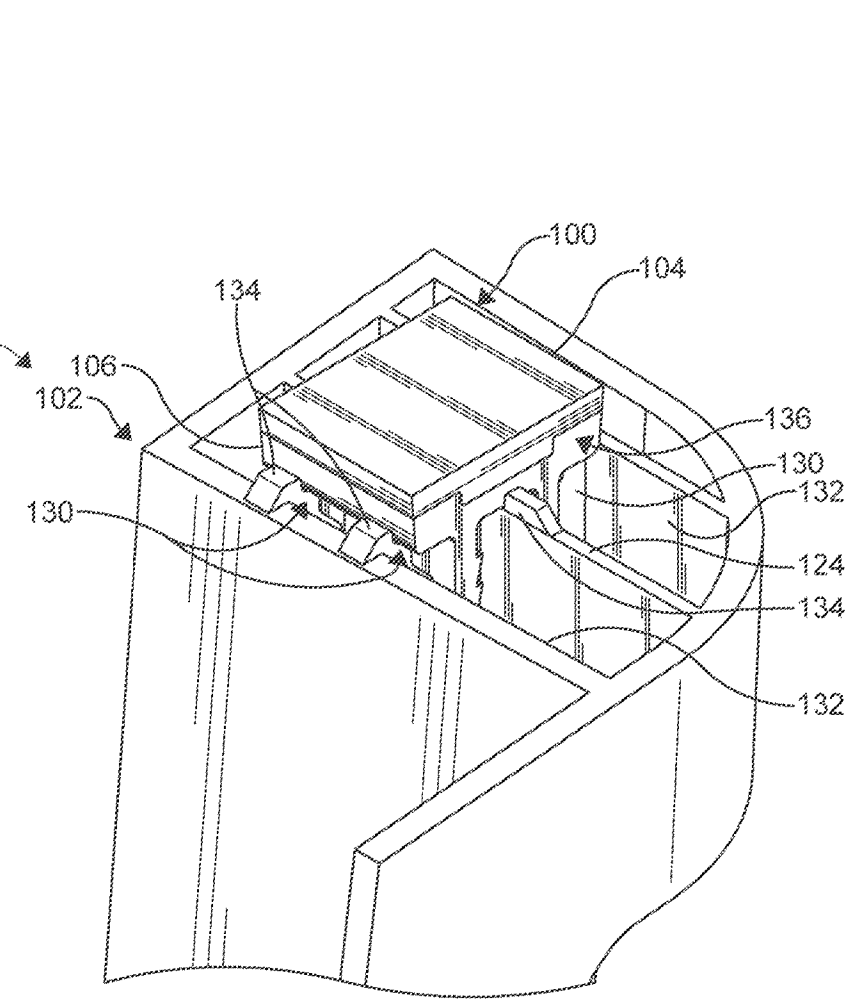
FIG. 8 is a bottom perspective view of the foot coupled to the portion of the article of outdoor furniture, according to the embodiment shown in FIG. 7.
Figure 7:
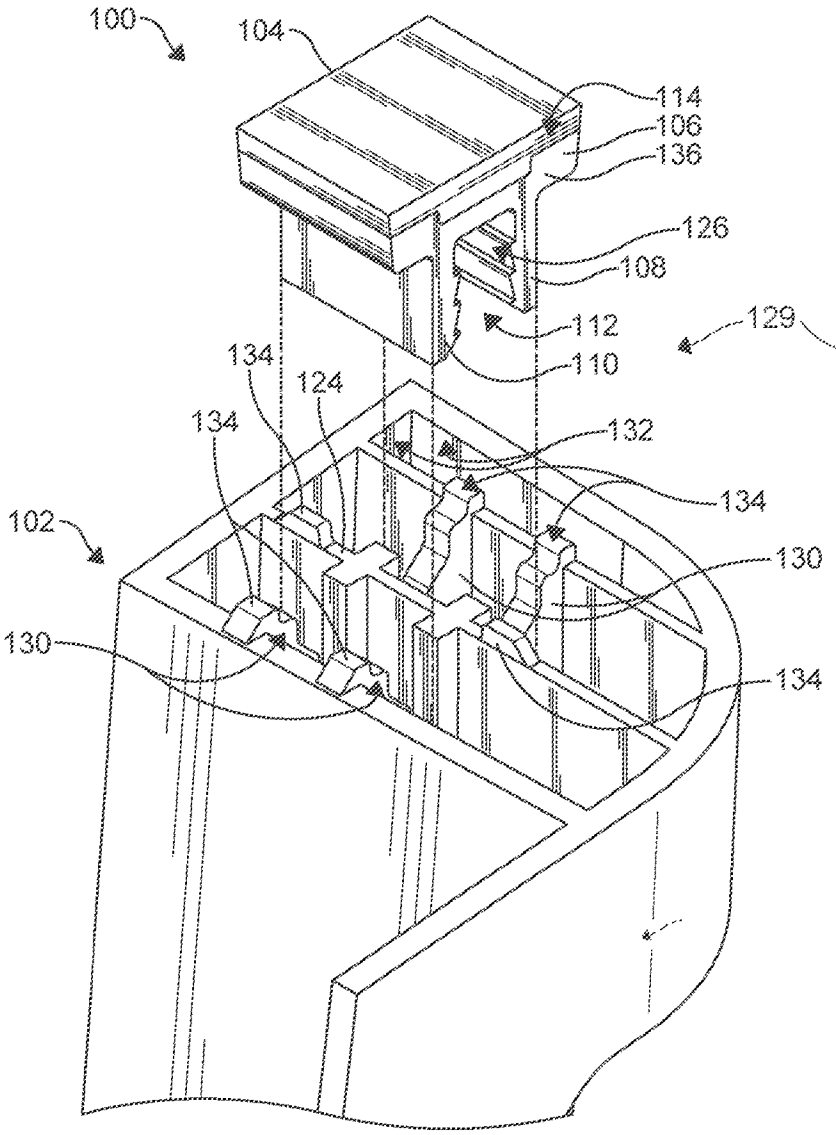
FIG. 7 is a bottom exploded perspective view of the foot and a portion of the article of outdoor furniture, according to an embodiment of the present disclosure.
Figure 9:
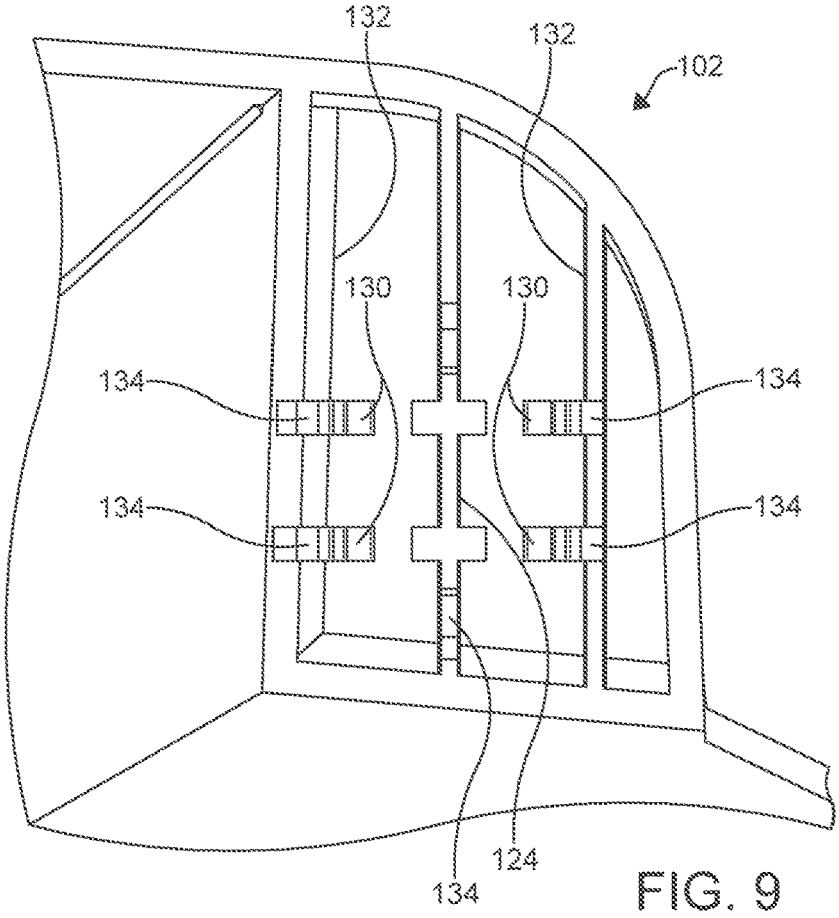
FIG. 9 is a bottom plan view of a portion of the article of outdoor furniture, according to another embodiment of the present disclosure.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments, including where certain steps can be simultaneously performed. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping, or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it may be directly on, engaged, connected, or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer, or section. Terms such as "first," "second," and other numerical terms when used herein do not imply a sequence or order unless clearly indicated by the context. Thus, a first element, component, region, layer, or section discussed below could be termed a second element, component, region, layer, or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the FIGS. is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

As shown in FIGS. 1-12, a foot 100 for an article of outdoor furniture 102 is provided that includes a base pad 104 and an anchor portion 106. The anchor portion 106 may include a prong system 108, 110 that has a friction fit retention means 112 configured to couple the foot 100 the article of outdoor furniture 102. A top surface 114 of the base pad 104 may be coupled to a bottom surface 116 of the anchor portion 106. The prong system 108, 110 may extend from a top surface 118 of the anchor portion 106 and may terminate at a top 109, 111 of the prong system 108, 110.

In certain circumstances, as illustrated in FIGS. 1-2, 5-8, and 10-12, the anchor portion 106 may be permanently coupled to the base pad 104. Unless otherwise stated, the anchor portion 106 is understood to be permanently coupled to the base pad 104 where the separation of the anchor portion 106 from the base pad 104 would result in breaking either or both the anchor portion 106 and the base pad 104. In a specific example, the anchor portion 106 may be formed by being co-extruded with the base pad 104. Co-extruding the base pad 104 and the anchor portion 106 can allow the two components to be merged or welded together into a single structure before cooling. In a more specific example, the top surface 114 of the base pad 104 may have a ridge 120 and the bottom surface 116 of the anchor portion 106 may include a channel 122. The channel 122 of the anchor portion 106 may be configured to accept the ridge 120 of the base pad 104. The complementary ridge 120 and channel 122 configuration is believed to strengthen the extruded connection between the anchor portion 106 and the base pad 104. Certain embodiments include where the base pad 104 and the anchor portion 106 are made of different materials. For example, the base pad 104 may be formed of material, such as a plastic or elastomer, that is softer and/or more flexible than a material used to form the anchor portion 106. In other examples, the base pad 104 may have a lower hardness value than the anchor portion 106. The hardness may be measured by a durometer hardness on the ASTM D2240 standard Shore durometer scales. In this way, the more rigid anchor portion 106 may provide strength and stability in coupling to the outdoor furniture 102 while the less rigid and/or more flexible base pad 104 may minimize marring, slippage, and/or splaying of legs of the furniture 102 when a load is applied thereto.

The base pad 104 may absorb and distribute force applied to the anchor portion 106. In particular examples, the base pad 104 may compress or deform, equalizing the force experienced by different sections of the anchor portion 106. In this way, the base pad 104 may alleviate the forces exerted on the anchor portion 106 and provide additional stability to the foot 100 as well as the article of outdoor furniture 102. This distribution of force may be particularly useful for ground surfaces which create uneven points of contact, or when the article of outdoor furniture 102 is moved or jostled. Additionally, when multiple feet 100 are affixed to an article of outdoor furniture 102, each of the feet 100 may experience a disproportionate amount of force. The base pad 104 of the foot may selectively flex and distribute the force appropriately to the anchor portions 106, thereby mitigating stress placed on the article of outdoor furniture 102.

As illustrated in FIGS. 1, 2, 5, 7-8, and 10, the ridge 120 at the top surface 114 of the base pad 104 may mitigate lateral forces by transferring lateral force to the channel 122 at the bottom surface 116 of the anchor portion 106. The configuration of the base pad 104 and the ridge 120 may militate against forces applied transverse to the alignment of the ridge 120 and channel 122. In other examples, the coextrusion of the base pad 104 and the anchor portion 106 may advantageously couple the complementary ridge 120 and channel 122 to further stabilize the foot 100. In further embodiments, the base pad 104 and the anchor 106 may contain additional sets of complementary ridge 120 and channel 122 configurations.

In certain examples, co-extrusion may also allow the different materials to maintain desired characteristic properties while allowing the materials to merge or weld together into a single structure before cooling. One skilled in the art may select other suitable configurations for coupling the anchor portion 106 to the base pad 104, within the scope of the present disclosure.

As shown in FIGS. 5, 7, and 10-11, the prong system 108, 110 of the anchor portion 106 may include a pair of prongs 108, 110. The pair of prongs 108, 110 may be specifically spaced apart to pinch a substantially vertical wall 124 of an article of outdoor furniture 102. Particular examples may include additional prong systems 108, 110, including additional pairs of prongs 108, 110 which can be received by additional substantially vertical walls 124. Each of the pair of prongs 108, 110 may include an inner surface 126. The inner surface 126 of each of the pair of prongs 108, 110 may further include the friction fit retention means 112. In a specific example, the friction fit retention means 112 may include an array of teeth 112 on the inner surface 126 of each of the pair of prongs 108, 110. In a more specific example, the array of teeth 112 may be angled in a manner configured to allow the anchor portion 106 to more easily accept the substantially vertical wall 124.

As a non-limiting example, the inner surface 127 of the uppermost tooth 128 of the array of teeth 112 may form a plane A which defines an angle X therebetween a plane B defined by the tops 109, 111 of the prong system. The angle X may be configured to guide the substantially vertical wall 124 into and between the pair of prongs 108, 110. In certain examples, the angle X of the uppermost tooth 128 may vary between a range of zero degrees to one hundred eighty degrees. In a particular example, the angle X of the uppermost tooth 128 and a similar angle defined by each top of the array of teeth 112 and plane B may differ. In a more particular example, the angle X of the uppermost tooth 128 may be around forty-five degrees.

Figure 10:
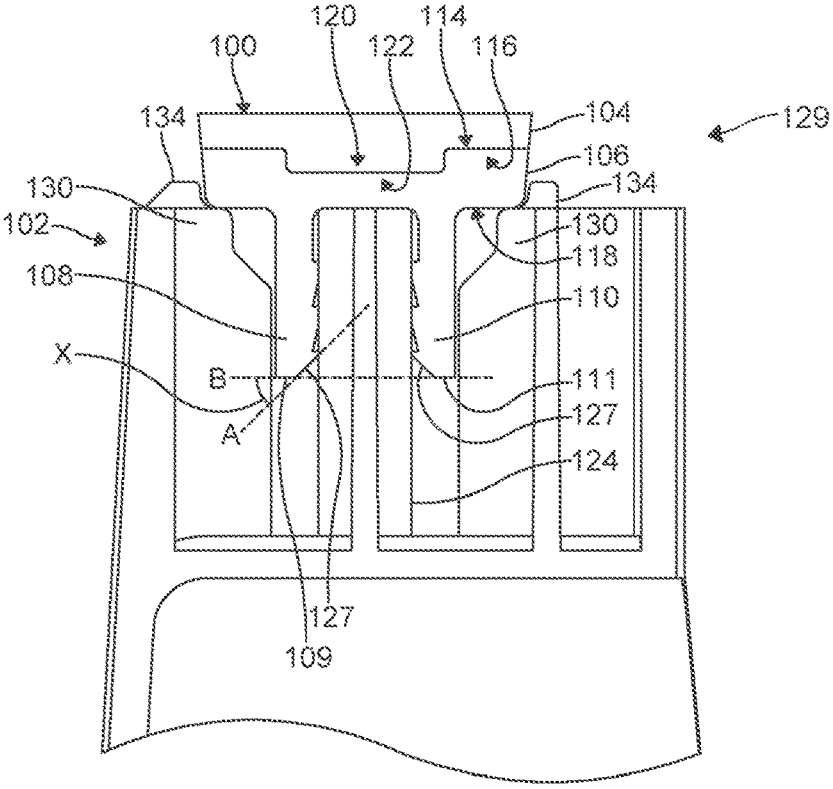
FIG. 10 is a cross-sectional view of the portion of the article of outdoor furniture, depicting a friction fit with the foot, where the foot is configured to bite into a substantially vertical wall of the article of outdoor furniture, according to another embodiment of the present disclosure.
Figure 11:
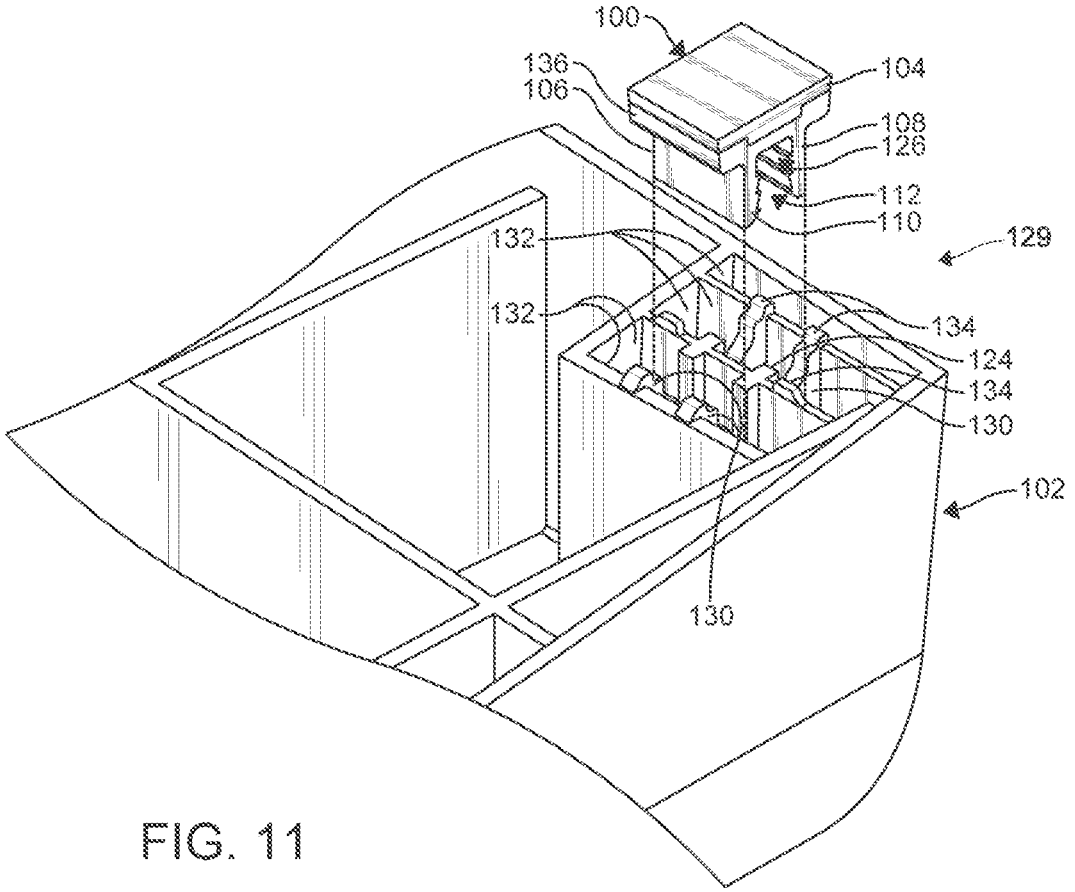
FIG. 11 is a bottom exploded perspective view of the foot and a portion of the article of outdoor furniture, according to another embodiment of the present disclosure.
Figure 12:
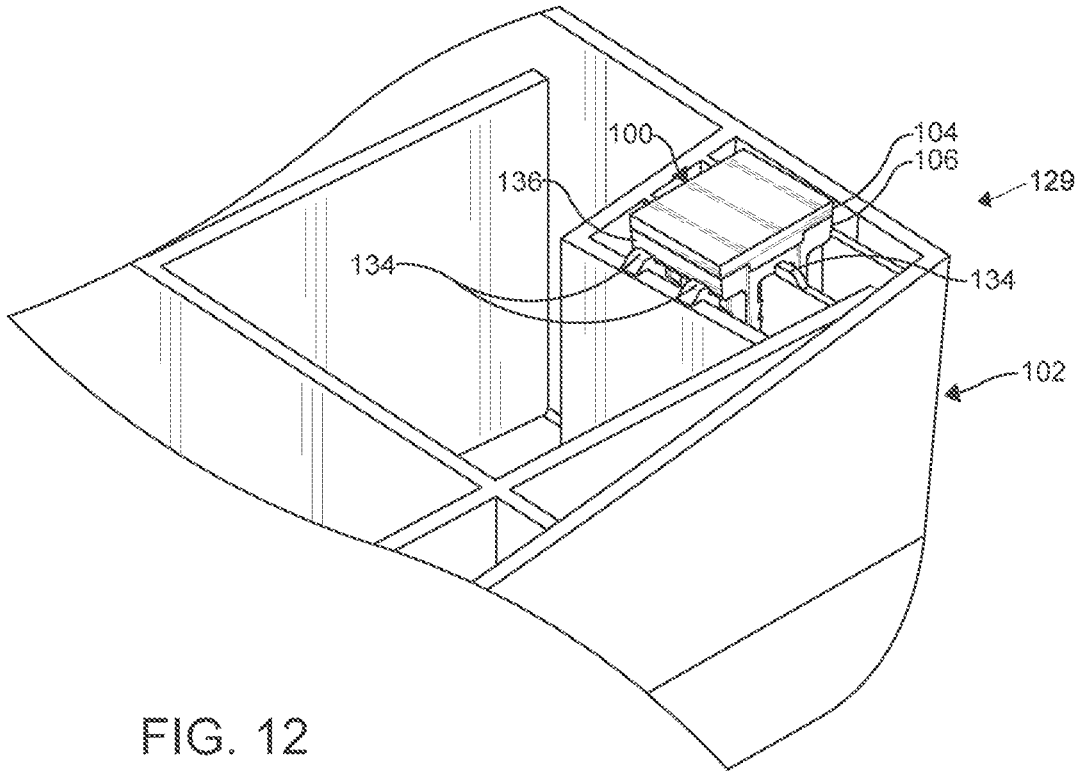
FIG. 12 is a bottom perspective view of the foot coupled to the portion of the article of outdoor furniture, according to the embodiment shown in FIG. 11.

As shown in FIG. 10, the array of teeth 112 may be configured to bite into the substantially vertical wall 124 and militate against the substantially vertical wall 124 from being removed from the anchor portion 106. Advantageously, the friction fit retention means 112 may permit the foot 100 to be easily coupled to the article of outdoor furniture 102, while also militating against the foot 100 from becoming decoupled from the article of outdoor furniture 102 once installed.

In particular examples, the anchor portion 106 may be constructed from a first material and the substantially vertical wall 124 may be constructed from a second material. In a more particular example, the first material may be a harder material than the second material. In a most particular example, the hardness of each material may be determined by a durometer hardness on the ASTM D2240 standard Shore durometer scales. Advantageously, the array of teeth 112 of the anchor portion 106 may more easily bite into the substantially vertical wall 124 where the material constructing the anchor portion 106 is harder than the material forming the substantially vertical wall 124. This can be particularly advantageous when the substantially vertical wall 124 has not fully hardened, further assisting the array of teeth 112 in biting into the substantially vertical wall 124.

As depicted in FIGS. 7-8 and 11-12, the foot 100 and the article of outdoor furniture 102 may form an article of outdoor furniture 102 foot 100 system 129. The article of outdoor furniture 102 foot 100 system 129 may include a foot 100 which includes an anchor portion 106 and a base pad 104 along with an article of outdoor furniture 102 which is configured to be coupled with the foot 100. The anchor portion 106 may include a prong system 108, 100 that is configured to provide a friction fit retention means 112 when the foot 100 is coupled to the article of outdoor furniture 102. The base pad 104 may be coupled to the bottom surface 116 of the anchor portion 106. The article of outdoor furniture 102 may include one or more internal walls 132. The one or more internal walls 132 may be substantially vertical walls configured to receive and/or provide support for the prong system 108, 110.

The article of outdoor furniture 102 foot 100 system 129 may include an article of outdoor furniture 102 with a space between the substantially vertical wall 124 and internal wall 132 which is configured to receive one of the prong systems 108, 110. In certain examples, the space between the substantially vertical wall 124 and internal wall 132 may have a width which allows the foot 100 to selectively contact portions of the article of outdoor furniture 102. The space between foot 100 and the substantially vertical wall 124 and/or the internal wall 132 may allow the foot 100 to bend, distort or deform, thereby reducing the internal stress on the article of outdoor furniture 102. In particular examples, the width of the space between the substantially vertical wall 124 and internal wall 132 have the same width as the prong system 108, 110, which may create a friction fit.

In certain embodiments, as shown in FIGS. 8-12, the article of outdoor furniture 102 may include additional supports for the foot 100. For instance, the article of outdoor furniture 102 may include ribs 130 to support the top surface 118 of the anchor portion 106. The ribs 130 may be provided on internal walls 132 and/or the substantially vertical wall 124 of the article of outdoor furniture 102. The ribs 130 may support the top surface 118 of the anchor portion 106. In a nonlimiting example, the ribs 130 may include rounded portions that allow the anchor portion 106 to selectively nest into the ribs 130. This can allow the foot 100 to retain a degree of movement, thereby dispersing and redirecting the force received by the article of outdoor furniture 102. The ribs 130 and/or the substantially vertical wall 124 may include protrusions 134 configured to be disposed adjacent to a sidewall 136 of the anchor portion 106, where the foot 100 is coupled to the article of outdoor furniture 102. Advantageously, the protrusions 134 may be configured to secure the foot 100 in a desired position on the article of outdoor furniture 102. It should be appreciated that the anchor portion 106 may contain multiple sidewalls 136, and the number of sidewalls 136 and the number of protrusions 134 may differ. Desirably, the protrusions 134 may also be configured to militate against the article of outdoor furniture 102 from independently laterally moving where a load is applied to the article of outdoor furniture 102. It should be appreciated that the protrusions 134 may be arranged in different configurations. In particular examples, prong systems 108 with additional pairs of prongs 108, 110 may require additional protrusions 134 in suitable configurations evident to persons of skill in the art.

With renewed reference to FIGS. 8-12, the ribs 130, the internal walls 132, and the protrusions 134 of the article of outdoor furniture 102 may stabilize the prong system 108, 110. The ribs 130 and the protrusions 134 may militate against lateral movement which may dislodge the friction fit retention means 112. Similarly, the internal walls 132 of the article of outdoor furniture 102, may also militate against lateral movement by limiting the movement of the prongs 108, 110 between the substantially vertical wall 124 and the internal walls 132. Advantageously, certain examples of the article of outdoor furniture 102 foot 100 system 129 may include gaps between the outdoor furniture 102 and foot 100 allowing the foot 100 to selectively absorb or disperse stress. For example, the anchor portion 106 may selectively contact the internal walls 132, allowing components of the anchor portion 106 to bend and contact the protrusions 134, thereby militating against lateral movement and/or torsion. Similarly, the prongs 108, 110 may selectively contact the substantially vertical wall 124 and the internal walls 132. The top surface 118 of the anchor portion 106 may selectively contact portions of ribs 130, allowing the foot 100 to support and selectively absorb stress from the article of outdoor furniture 102. In this way, when the article of outdoor furniture 102 is subjected to forces that change in direction and intensity, the foot 100 may remain stable while dispersing the force throughout the foot and various contact points on the article of outdoor furniture 102. In further examples, the article of outdoor furniture 102 foot 100 system 129 may be formed out of one unitary body and maintain similar advantages by retaining selective contact points. It should also be appreciated that the article of outdoor furniture 102 foot 100 system 129 may be formed out of one unitary body where the prong system 108, 110, the ribs 130, the protrusions 134, the substantially vertical wall 124 and combinations thereof are molded or extruded with the article of outdoor furniture 102.

Advantageously, the foot 100 may allow the article of outdoor furniture 102 to reduce the internal stress placed on the article of outdoor furniture 102, thereby increasing holding strength. For example, the use of a foot 100 under stress tests involving glass surfaces and 200 pound weights demonstrated that articles of outdoor furniture 102 utilizing four feet performed substantially better than articles of outdoor furniture 102 without feet. Further, articles of outdoor furniture 102 without all four feet lost anywhere from 47%-70% of their holding strength. The foot 100 is secured by the protrusions 134, mitigating lateral forces which can damage the foot 100 and the prong system 108, 110. This allows the foot 100 to withstand greater forces and prevent the prong system 108, 110 from becoming decoupled, thereby increasing safety.

It should be appreciated that the article of outdoor furniture 102 may encompass various tables, benches, stools, chairs, containers, storage units, and other suitable articles of outdoor furniture 102 known to those skilled in the art. The foot 100 may be used with any article of outdoor furniture 102 regardless of whether the article of outdoor furniture has legs, or the method used in forming the article of outdoor furniture 102. Likewise, it should also be appreciated that the foot 100 may encompass a variety of different shapes and structures to accommodate different articles of outdoor furniture 102. To that point, the foot 100 may include a base pad 104 that is configured to militate against sliding with respect to a specific ground surface, improving friction and thereby increasing skid resistance. The anchor portion 106 may also be altered to accommodate for increased lateral forces and torsion. Similarly, the complementary ridge 120 and channel 122 configuration may incorporate a variety of shapes and structures. Different configurations of the complementary ridge 120 and channel 122 may be utilized by those with skill in the art. For example, the complementary ridge 120 and the channel 122 could contain additional ridges and channels, or mating grips, advantageously strengthening the connection between the anchor portion 106 and the base pad 104.

Figure 13:
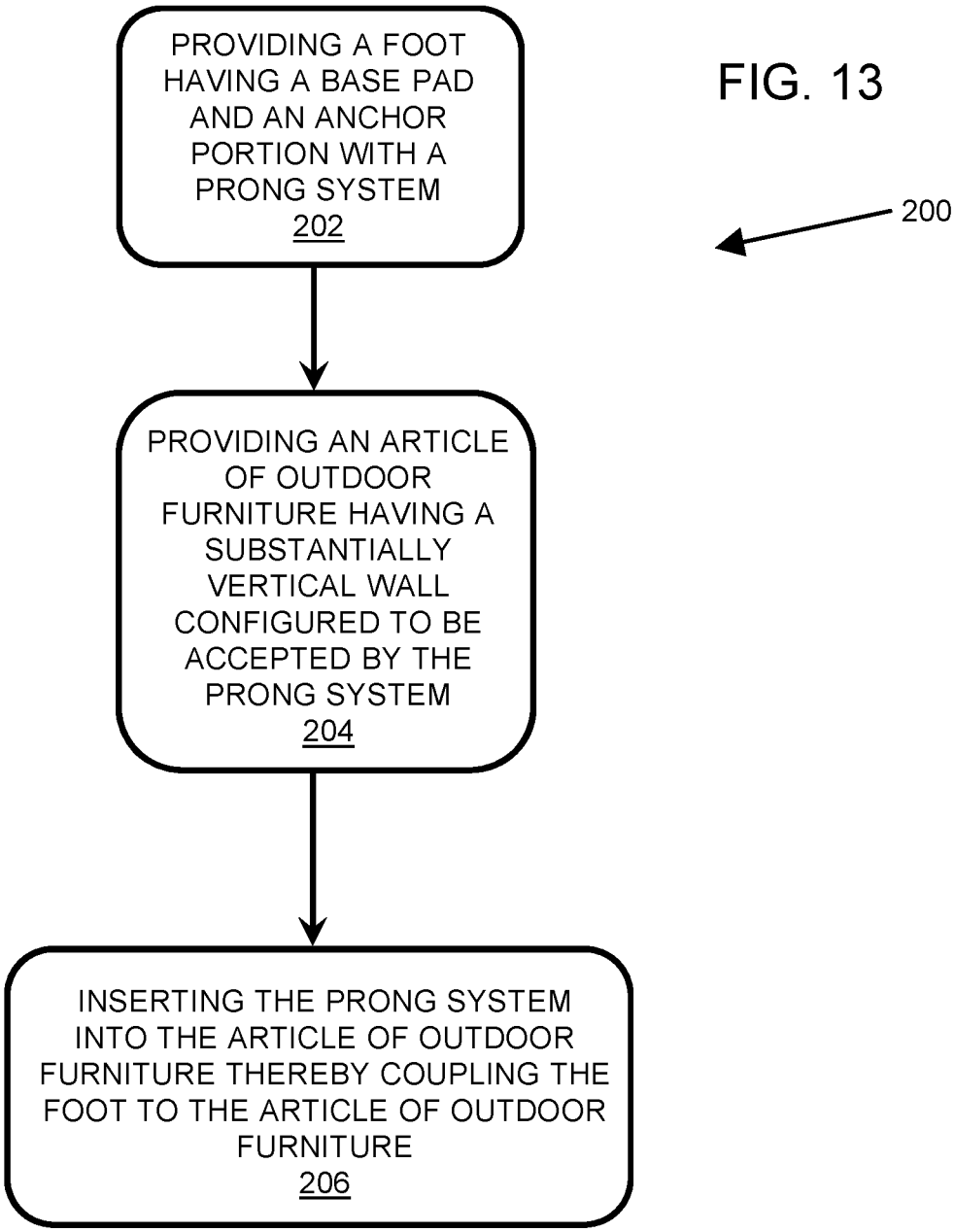
FIG. 13 is a flow chart illustrating a method of coupling the foot to the article of outdoor furniture, according to an embodiment of the present disclosure.

The foot 100 may be coupled to an article of outdoor furniture 102 by various methods. As shown in FIG. 13, one method 200 may include a step 202 of providing a foot 100 having a base pad 104 and an anchor portion 106. The anchor portion 106 may include a prong system 108, 110 that is configured to provide a friction fit 112, allowing the foot 100 to be coupled to the article of outdoor furniture 102. A top surface 114 of the base pad 104 may be coupled to a bottom surface 116 of the anchor portion 106. The method 200 may also include a step 204 of providing an article of outdoor furniture 102 having a substantially vertical wall 124 configured to be accepted by the prong system 108, 110. Next, the method 200 may include a step 206 of inserting the prong system 108, 110 of the foot 100 into the article of outdoor furniture 102 thereby coupling the prong system 108, 110 of the foot 100 with the substantially vertical wall 124 of the article of outdoor furniture 102. Step 206 may be accomplished by inserting the prong system 108, 110 in a manner that wedges the substantially vertical wall 124 of the article of outdoor furniture 102 between the prong system 108, 110. This may create a friction fit and couple the foot 100 to the article of outdoor furniture 102.

Figure 14:
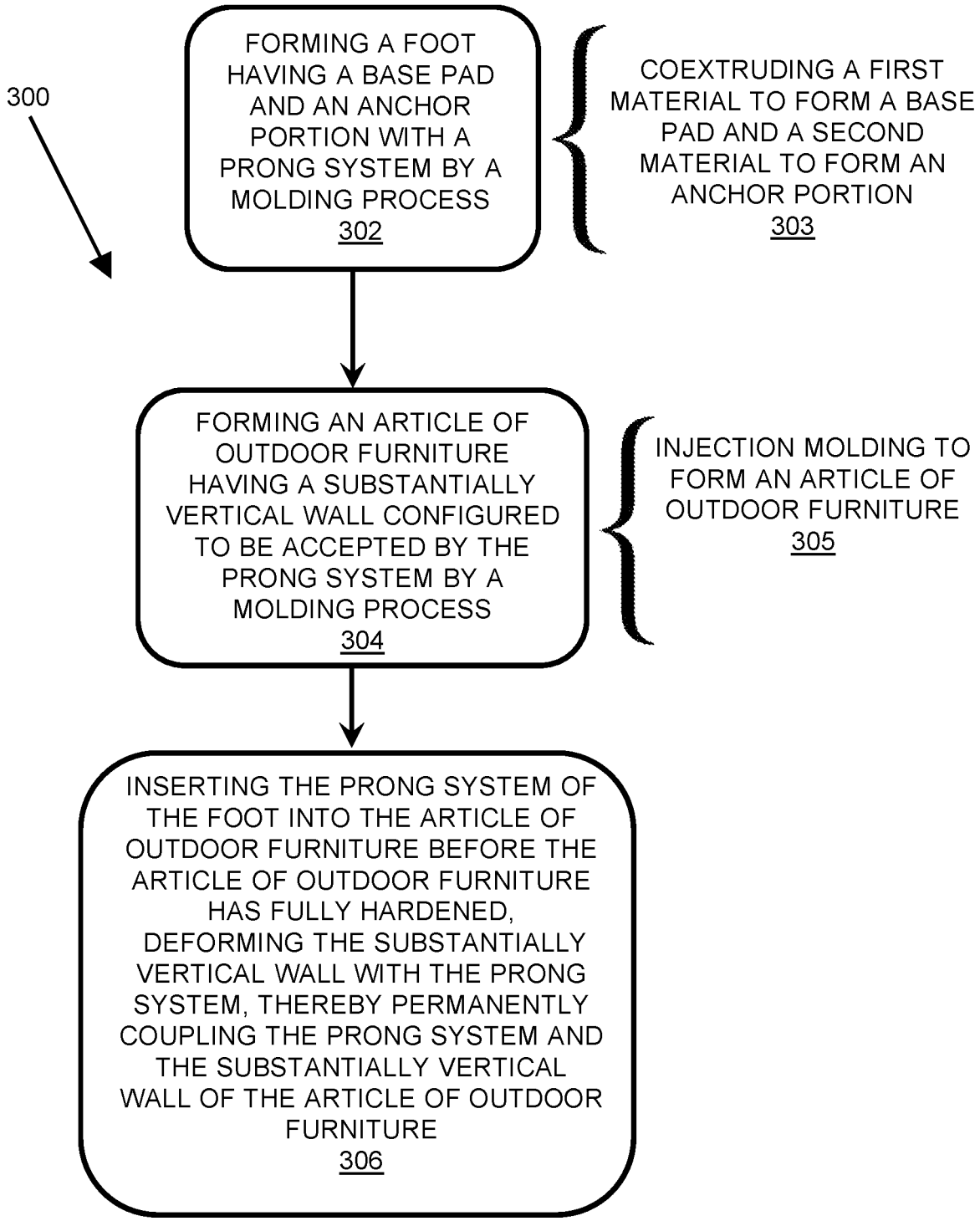
FIG. 14 is a flow chart illustrating another method of coupling the foot to the article of outdoor furniture, according to another embodiment of the present disclosure.

As shown in FIG. 14, another method 300 for coupling the foot 100 to the article of outdoor furniture 102 may include a step 302 of forming a foot 100 by a molding process. Alternatively, the step 302 of forming a foot 100 can include a step 303 of coextruding a first material to form a base pad 104 and a second material to form an anchor portion 106. The anchor portion 106 may include a prong system 108, 110 that has a friction fit retention means 112 configured to couple the foot 100 the article of outdoor furniture 102. A top surface 114 of the base pad 104 may be coupled to a bottom surface 116 of the anchor portion 106. The method 300 may also include a step 304 of forming an article of outdoor furniture 102 by a molding process. The article of outdoor furniture 102 may have a substantially vertical wall 124 configured to be accepted by the prong system 108, 110. Next, the method 300 may include a step 306 of inserting the prong system of the foot 100 into the article of outdoor furniture 102 before the article of outdoor furniture 102 has cooled and/or fully hardened. When step 306 occurs before the article of outdoor furniture 102 has fully hardened, the friction fit retention means 112 of the prong system 108, 110 may pinch the substantially vertical wall 124 which may deform, thereby coupling the prong system and the substantially vertical wall 124. During step 306, the article of outdoor furniture 102 may be at a critical range of temperature which allows the foot 100 to deform the substantially vertical wall 124. The critical range of temperature ensures that the substantially vertical wall 124 of the article of outdoor furniture 102 is malleable enough to be deformed by the prong system 108, 110 of the foot 100. In a more particular example, the critical range of temperature allows the substantially vertical wall 124 to be malleable enough to deform and resilient enough to selectively resist against the array of teeth 112 of the friction fit retention means 112. More specifically, the critical range of temperature may allow the friction fit retention means 112 to be inserted into the article of outdoor furniture 102 without substantially deforming the substantially vertical wall 124 and only deform the substantially vertical wall 124 once the array of teeth 112 of the friction fit retention means 112 are fully inserted. In a further embodiment, this may be facilitated by the shape and/or angle of the internal walls 132.

In a particular example, removing the foot 100 from the article of outdoor furniture 102 would result in breaking either or both the foot 100 and the article of outdoor furniture 102. In more particular example, removing a foot 100 that is coupled to the article of outdoor furniture 102 by the methods shown in FIGS. 13-14 would result in permanently coupling the foot 100 and the article of outdoor furniture 102. Decoupling, or taking apart the permanently coupled foot 100 and the article of outdoor furniture 102 would result in breaking either or both the foot 100 and the article of outdoor furniture 102. In a most particular example, removing a foot 100 that is coupled to the article of outdoor furniture 102 by the method of FIGS. 13-14 would result in breaking the prong system 108, 110 of the foot 100 rather than the article of outdoor furniture 102. In certain examples, the foot 100 may be permanently coupled to the article of outdoor furniture 102, where separating the foot 100 and the article of outdoor furniture 102 would result in breaking the uppermost tooth 128 of the prong system 108, 110. Advantageously, the foot 100 may be more economically manufactured compared to the article of outdoor furniture 102, and may be replaced in some circumstances.

Advantageously, the foot 100 for the article of outdoor furniture 102 has enhanced durability, provides a means to adequately retain the foot 100 to the article of outdoor furniture 102, and does not greatly add to the cost of manufacturing the article of outdoor furniture 102.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions, and methods can be made within the scope of the present technology, with substantially similar results.

What is claimed is:

1. A foot for an article of outdoor furniture, comprising:

an anchor portion including a prong system including a pair of prongs, the prong system configured to provide a friction fit when the foot is coupled to an article of outdoor furniture, each prong of the pair of prongs including an array of angled teeth disposed on an inner surface thereof; and a base pad coupled to a bottom surface of the anchor portion, wherein a top central surface of the base pad has a ridge, a bottom central surface of the anchor portion has a channel configured to accept the ridge of the base pad, and a width of the ridge and a width of the channel is configured between each prong of the pair of prongs.

2. The foot for an article of outdoor furniture of claim 1, wherein the prong system extends from a top surface of the anchor portion.

3. The foot for an article of outdoor furniture of claim 1, wherein the anchor portion is permanently coupled to the base pad.

4. The foot for an article of outdoor furniture of claim 1, wherein the anchor portion and the base pad are co-extruded.

5. The foot for an article of outdoor furniture of claim 1, wherein a top surface of the base pad has a ridge and a bottom surface of the anchor portion has a channel configured to accept the ridge of the base pad.

6. The foot for an article of outdoor furniture of claim 1, wherein the base pad and the anchor portion are made of different materials.

7. The foot for an article of outdoor furniture of claim 1, wherein the base pad or the anchor portion is formed of a plastic or elastomer, and wherein the base pad has a lower hardness value than the anchor portion.

8. The foot for an article of outdoor furniture of claim 2, wherein the prong system further includes a friction fit retention means.

9. The foot for an article of outdoor furniture of claim 1, wherein the array of teeth is angled to allow the anchor portion to accept a substantially vertical wall of a leg of outdoor furniture therebetween.

10. The foot for an article of outdoor furniture of claim 1, wherein the array of teeth includes an uppermost tooth including a top, the top forming a plane defining an angle of about forty-five degrees therebetween a plane defined by a top of the prong system.

11. The foot for an article of outdoor furniture of claim 1, wherein the array of teeth is configured to provide the friction fit when the foot is coupled to the article of outdoor furniture.

12. An outdoor furniture foot system comprising:

a foot for an article of outdoor furniture including:

an anchor portion including a prong system including a pair of prongs, the prong system configured to provide a friction fit when the foot is coupled to the article of outdoor furniture, each prong of the pair of prongs including an array of angled teeth disposed on an inner surface thereof;

a base pad coupled to a bottom surface of the anchor portion, wherein a top central surface of the base pad has a ridge, a bottom central surface of the anchor portion has a channel configured to accept the ridge of the base pad, and a width of the ridge and a width of the channel is configured between each prong of the pair of prongs; and an article of outdoor furniture configured to be coupled with the foot for an article of outdoor furniture.

13. The outdoor furniture foot system of claim 12, wherein the article of outdoor furniture includes internal walls wherein at least one internal wall is a substantially vertical wall configured to be received by the prong system.

14. The outdoor furniture foot system of claim 13, wherein an internal wall includes a rib configured to support a top surface of the anchor portion.

15. The outdoor furniture foot system of claim 14, wherein the rib or the substantially vertical wall includes protrusions configured to be disposed adjacent to a sidewall of the anchor portion.

16. An outdoor furniture foot system of claim 12, wherein the foot and the article of outdoor furniture are permanently coupled.

17. A method for coupling a foot to an article of outdoor furniture, comprising:

providing a foot including:

an anchor portion including a prong system including a pair of prongs, the prong system configured to provide a friction fit when the foot is coupled to an article of outdoor furniture, each prong of the pair of prongs including an array of angled teeth disposed on an inner surface thereof; and a base pad coupled to a bottom surface of the anchor portion, wherein a top central surface of the base pad has a ridge, a bottom central surface of the anchor portion has a channel configured to accept the ridge of the base pad, and a width of the ridge and a width of the channel is configured between each prong of the pair of prongs;

providing an article of outdoor furniture having a substantially vertical wall configured to be accepted by the prong system; and inserting the prong system of the foot into the article of outdoor furniture, wherein the substantially vertical wall is wedged within the prong system, thereby coupling the foot to the article of outdoor furniture.

18. The method of claim 17, wherein the article of outdoor furniture is formed by a molding process, wherein inserting the prong system of the foot into the article of outdoor furniture deforms the substantially vertical wall, and wherein coupling the foot to the article of outdoor furniture occurs before the article of outdoor furniture has fully hardened from the molding process, thereby permanently coupling the foot and the article of outdoor furniture.

* * * * *